United States Patent [19]

Ferm

[11] Patent Number: 4,469,586

[45] Date of Patent: Sep. 4, 1984

[54] HEAT EXCHANGER ANTIFOULANT

[75] Inventor: Richard L. Ferm, Lafayette, Calif.

[73] Assignee: Chevron Research Company, San Francisco, Calif.

[21] Appl. No.: 429,696

[22] Filed: Sep. 30, 1982

[51] Int. Cl.[3] ..... C10G 9/12

[52] U.S. Cl. ..... 208/48 AA; 252/482

[58] Field of Search ..... 208/48 AA; 252/48.2

[56] References Cited

U.S. PATENT DOCUMENTS

| | | | |
|---|---|---|---|
| 2,677,617 | 5/1954 | Thompson | 252/48.2 |
| 2,947,787 | 8/1960 | Flanagan | 252/48.2 |
| 2,956,951 | 10/1960 | Furey | 252/48.2 |
| 3,105,810 | 10/1963 | Miller et al. | 208/48 AA |
| 3,449,440 | 6/1969 | Andersen | 252/48.2 |
| 3,759,956 | 9/1973 | Stapp | 252/48.2 |
| 3,920,572 | 11/1975 | King et al. | 208/48 AA |
| 4,116,812 | 9/1978 | Godar et al. | 208/48 AA |
| 4,122,021 | 10/1978 | Loveless et al. | 252/48.2 |

FOREIGN PATENT DOCUMENTS

| | | | |
|---|---|---|---|
| 133570 | 1/1979 | Fed. Rep. of Germany | 208/48 AA |
| 120689 | 3/1980 | Japan | 208/48 AA |

*Primary Examiner*—Delbert E. Gantz
*Assistant Examiner*—Cynthia A. Prezluck
*Attorney, Agent, or Firm*—J. A. Buchanan, Jr.; D. A. Newell; J. J. DeYoung

[57] ABSTRACT

Disclosed is a process for reducing the fouling in a heat exchanger in which a hydrocarbon stream is heated or cooled as it passes through the heat exchanger. From 1 to 500 parts per million of a saturated sulfoxide is added to the stream to reduce fouling.

7 Claims, No Drawings

HEAT EXCHANGER ANTIFOULANT

BACKGROUND OF THE INVENTION

The invention relates to heat exchangers, particularly heat exchangers used in the processing of crude oil. More particularly, the invention relates to an additive for reducing heat exchanger fouling.

In the processing of petroleum, numerous heat exchangers are utilized to heat or cool process streams. Since refineries typically process very large quantities of petroleum ranging from 25,000 to 200,000 or more barrels per day, the heat exchangers in the refinery represent a very large capital investment. After a period of operation, deposits build up on the heat exchanger tubes greatly reducing heat exchanger efficiency and greatly increasing the energy consumed. Eventually, the heat exchanger must be taken out of operation and the tubes cleaned or replaced. Increasing heat exchanger efficiency and reducing the amount and rate of fouling can provide tremendous energy savings in refineries and other facilities that use heat exchangers.

DESCRIPTION OF THE PRIOR ART

Numerous heat exchanger antifoulant additives are well known in the art, for example, U.S. Pat. Nos. 4,280,894; 3,647,677; 4,200,518; 3,574,088, and 3,342,723. U.S. Pat. No. 3,647,677 teaches the use of phosphines as a coke retardant. U.S. Pat. No. 4,280,894 teaches the use of dibenzothiophenes to improve the thermal stability of hydrocarbon mixtures. U.S. Pat. No. 4,200,518 teaches the use of a polyalkylene amine as a heat exchanger antifoulant. U.S. Pat. No. 3,574,088 teaches the use of amine compounds as antifoulants.

SUMMARY OF THE INVENTION

A process for reducing heat exchanger fouling in which a liquid hydrocarbon stream is passed through a heat exchanger at a temperature from 0° to 1500° F. wherein from 1 to 500 parts per million of an antifoulant additive is added to said hydrocarbon stream, said additive comprising a saturated sulfoxide.

DETAILED DESCRIPTION OF THE INVENTION

The heat exchangers utilized in the present invention are of any type where deposits accumulate on a heat transfer surface. The most common type of heat exchanger used is commonly known as a shell and tube heat exchanger.

The hydrocarbon stream passing through the heat exchanger is preferably a crude oil stream. Particularly preferred are petroleum stocks that contain reactive hydrocarbons such as olefins, sulfur, and nitrogen compounds. However, any hydrocarbon stream which leads to fouling of the heat exchanger can be utilized in the present invention, particularly various fractions of the crude oil. Generally, the streams passing through the heat exchanger will be heated or cooled at temperatures ranging from 0° to 1500°F., preferably 50° to 1000° F.

The Saturated Sulfoxides

Any saturated sulfoxide which prevents fouling can be used in the present invention. Saturated sulfoxides which are useful in the present invention include the dialkylsulfoxides and cyclic sulfoxides. The alkyl group may contain 1 to 6 carbon atoms, e.g., methyl, ethyl, propyl, butyl, etc. Particularly preferred is dimethyl sulfoxide and diethyl sulfoxide. Cyclic sulfoxides will contain 4 to 5 carbon atoms in the ring. Preferred is tetramethylene sulfoxide and pentamethylenesulfoxide.

Many of the saturated sulfoxides described above are available commercially. They can also be made by oxidizing the corresponding dialkyl sulfide using well known peroxidic initiators.

To substantially reduce heat exchanger fouling, an effective amount, generally from 1 to 500 parts per million, preferably 5 to 99 parts per million, and most preferably 10 to 49 parts per million of the above-described sulfoxide is added to the stream passing through the heat exchanger. One surprising feature of the present invention resides in the finding that such small quantities of the above-described additive are effective in reducing heat exchanger fouling.

EXAMPLES 1-16

Antifouling Tests

Various compounds were tested for their antifouling characteristics using a standard ALCOR Test Apparatus. This test involves feeding a test stock material at a fixed rate and for a fixed period of time and at constant inlet temperature into a tube containing a stainless steel electrically heated rod while supplying enough heat to the rod to maintain the outlet temperature of the test stock constant. As fouling deposits form on the rod, the temperature of the rod must be increased to maintain a constant outlet temperature of the test stock. The initial rod temperature and final rod temperature are measured along with the initial and final weight of the rod. The increase in rod temperature and the amount of deposits on the rod are indicative of the degree and rate of fouling.

Each test run was for three hours and either no additive was used or 2-50 parts per million of additive was added to the test stock. The inlet temperature of the test stock was maintained at 70° F. and the outlet temperature was maintained at 600° F. The test stock was a naphtha hydrotreater feedstock. The results are shown below in the Table.

TABLE I

| Test No. | Additive (Concentration, ppm) | ΔT, °F. | Deposit Wt, mg |
|---|---|---|---|
| 1 | None | 33 | 11.7 |
| 2 | None | 21 | 2.1 |
| 3 | None | 25 | 3.9 |
| 4 | Dimethyl Sulfoxide (50) | −10 | 3.0 |
| 5 | Dimethyl Sulfoxide (35) | −1 | 4.7 |
| 6 | Dimethyl Sulfoxide (15) | 0 | 6.2 |
| 7 | Dimethyl Sulfoxide (5) | −4 | 5.7 |
| 8 | Dimethyl Sulfoxide (2) | −17 | 4.6 |
| 9 | Dimethyl Sulfide (50) | 69 | 10.1 |
| 10 | Diethyl Hydroxylamine (50) | 14 | 9.8 |
| 11 | Cyclohexyl Amine (50) | 27 | 15.4 |
| 12 | Triphenyl Phosphine (50) | 15 | 3.8 |
| 13 | Dimethyl Aniline (50) | 48 | 12.8 |
| 14 | Polybutene Diamine (50) | 28 | 6.4 |
| 15 | N,N'—Di-Sec.-Butyl-P—Phenylenediamine (50) | 40 | 9.2 |
| 16 | 2,4-Dimethyl-6-Tert.-Butylphenol (50) | 19 | 3.7 |

Comparison of Examples 1-3 with 4-8 indicates that dimethyl sulfoxide is highly effective as a heat exchanger antifoulant. Comparison of Example 4 with Example 9 indicates the unique nature of dimethyl sulfoxide as compared to dimethyl sulfide. Examples 10–16 represent other antioxidants and antifoulants.

What is claimed is:

1. A process for reducing heat exchanger fouling in which a liquid hydrocarbon stream is passed through a heat exchanger at a temperature from 0° to 1500° F. wherein from 1 to 500 parts per million of an antifouling additive is added to said hydrocarbon stream, said additive comprising a dialkyl sulfoxide wherein the alkyl group contains 1 to 6 carbon atoms.

2. The process of claim 1 wherein said stream is crude oil or a fraction thereof.

3. The process of claim 2 wherein said dialkylsulfoxide is selected from dimethyl sulfoxide, diethyl sulfoxide, tetramethylene sulfoxide.

4. The process of claim 3 wherein said dialkylsulfoxide is dimethyl sulfoxide.

5. The process of claim 1 wherein 5 to 99 parts per million of said additive are added to said stream.

6. The process of claim 1 wherein said hydrocarbon stream is passed through said heat exchanger at a temperature from 50° to 1000° F.

7. The process of claims 3 or 4 wherein said heat exchanger is a shell and tube heat exchanger.

* * * * *